US008054945B2

(12) United States Patent
Andrews

(10) Patent No.: US 8,054,945 B2
(45) Date of Patent: Nov. 8, 2011

(54) EVACUATED ENCLOSURE WINDOW COOLING

(75) Inventor: Gregory C. Andrews, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 84 days.

(21) Appl. No.: 12/541,802

(22) Filed: Aug. 14, 2009

(65) Prior Publication Data

US 2011/0038461 A1 Feb. 17, 2011

(51) Int. Cl.
*H01J 35/18* (2006.01)

(52) U.S. Cl. ..... 378/141; 378/140; 378/161

(58) Field of Classification Search ..... 378/140, 378/141, 161

See application file for complete search history.

(56) References Cited

U.S. PATENT DOCUMENTS 2,480,198 A * 8/1949 Rogers ..... 378/66
6,215,852 B1 * 4/2001 Rogers et al. ..... 378/142
6,263,046 B1 7/2001 Rogers
6,438,208 B1 8/2002 Koller
6,529,579 B1 * 3/2003 Richardson ..... 378/130
6,594,341 B1 * 7/2003 Lu et al. ..... 378/140
6,714,626 B1 3/2004 Subraya et al.
6,980,628 B2 * 12/2005 Wang et al. ..... 378/140
7,016,472 B2 3/2006 Subraya et al.
7,616,736 B2 * 11/2009 Warburton ..... 378/140
7,839,980 B2 * 11/2010 Lu et al. ..... 378/141

* cited by examiner

*Primary Examiner* — Edward Glick
*Assistant Examiner* — Thomas R Artman
(74) *Attorney, Agent, or Firm* — Maschoff Gilmore & Israelsen

(57) ABSTRACT

In one example, an x-ray tube includes an evacuated enclosure and an anode disposed with the evacuated enclosure. The anode is configured to receive electrons emitted by an electron emitter. The x-ray tube also includes an evacuated enclosure window disposed within a port of the evacuated enclosure. The evacuated enclosure window includes first and second axes, the first axis being relatively shorter than the second axis. The x-ray tube also includes means for directing coolant flow. The means for directing coolant flow causes coolant to flow across an exterior surface of the evacuated enclosure window in a direction substantially parallel to the first axis.

19 Claims, 8 Drawing Sheets

EVACUATED ENCLOSURE WINDOW COOLING

BACKGROUND

1. Field of the Invention

Embodiments of the present invention relate generally to x-ray devices. More particularly, embodiments of the present invention relate to devices, systems and methods for cooling evacuated enclosure windows employed in x-ray devices.

2. Related Technology

The x-ray tube has become essential in medical diagnostic and inspection imaging, medical therapy, and various medical testing and material analysis industries. Such equipment is commonly employed in areas such as medical and industrial diagnostic examination, therapeutic radiology, semiconductor fabrication, and materials analysis.

An x-ray tube typically includes a vacuum enclosure that contains a cathode assembly and an anode assembly. The vacuum enclosure may be composed of metals, glass, ceramic, or a combination thereof, and is typically disposed within an outer housing. A cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating the coolant to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a focal track that is oriented to receive electrons emitted by the cathode assembly.

The evacuated enclosure includes an evacuated enclosure window aligned with the focal track such that x-rays emitted from the focal track can pass out of the evacuated enclosure. The evacuated enclosure window is typically disposed in a port formed in a wall of the evacuated enclosure and is attached to the evacuated enclosure by welding, brazing, or other methods.

During operation of the x-ray tube, the anode is rotated and the cathode is charged with a heating current that causes electrons to escape the electron source or emitter. An electric potential is applied between the cathode and the anode in order to accelerate the emitted electrons toward the annular focal track of the anode. X-rays are generated by a portion of the highly accelerated electrons striking the annular focal track.

In order to produce high-quality x-ray images, it is generally desirable to maximize x-ray flux, i.e., the number of x-ray photons emitted per unit time. X-ray flux can be increased by increasing the number of electrons emitted by the electron emitter that impinge on the focal track.

However, many of the electrons that strike the focal track are backscattered from the focal track towards the evacuated enclosure window. The number of backscatter electrons is generally proportional to the number of electrons that impinge on the focal track. When the backscattered electrons strike the evacuated enclosure window, a significant amount of their kinetic energy is transferred to the evacuated enclosure window as thermal energy. Without an effective cooling mechanism, the evacuated enclosure window can overheat and fail, thereby compromising the evacuated enclosure and the ability of the x-ray tube to operate. Accordingly, because the number of backscatter electrons is proportional to the number of electrons that impinge on the focal track, the cooling inefficiency of the x-ray tube effectively imposes a limit on the maximum number of electrons that can be emitted by the electron emitter toward the focal track, and, as a result, on the quality of the x-ray images produced by the x-ray tube.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF SOME EXAMPLE EMBODIMENTS

In general, example embodiments relate to devices, systems and methods for cooling evacuated enclosure windows employed in x-ray tubes.

One example embodiment includes an x-ray tube. The x-ray tube includes an evacuated enclosure and an anode disposed within the evacuated enclosure. The anode is configured to receive electrons emitted by an electron emitter. The x-ray tube also includes an evacuated enclosure window disposed within a port of the evacuated enclosure. The evacuated enclosure window includes first and second axes, the first axis being relatively shorter than the second axis. The x-ray tube also includes means for directing coolant flow. The means for directing coolant flow causes coolant to flow across an exterior surface of the evacuated enclosure window in a direction substantially parallel to the first axis.

Another example embodiment includes a method of cooling an x-ray tube. The method includes generating coolant flow in an x-ray tube comprising an evacuated enclosure window, the evacuated enclosure window including first and second axes, the first axis being relatively shorter than the second axis. The method also includes directing coolant across an exterior surface of the evacuated enclosure window in a direction substantially parallel to the first axis. The method also includes optimizing coolant flow across the exterior surface according to a non-uniform distribution of backscatter electrons that strike an interior surface of the evacuated enclosure window.

Yet another example embodiment includes an x-ray tube comprising an outer housing, an evacuated enclosure, an electron emitter, an anode, and a plenum. The evacuated enclosure is disposed within the outer housing and includes an evacuated enclosure window having a short axis. The electron emitter is disposed within the evacuated enclosure and is configured to emit electrons. The anode is disposed within the evacuated enclosure so as to receive electrons emitted by the electron emitter. The anode defines an axis of rotation that is substantially parallel to the short axis. The plenum is disposed within the outer housing and has an end with at least one opening formed in the end. The plenum is arranged such that the end is substantially normal to the short axis.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Embodiments of the present invention are generally directed to an x-ray tube including a plenum or other means for directing coolant flow across an evacuated enclosure window of the x-ray tube heated by backscatter electrons striking the evacuated enclosure window. Some example embodiments include an x-ray tube having an evacuated enclosure, an anode disposed within the evacuated enclosure and configured to receive electrons emitted by an electron emitter, an evacuated enclosure window disposed in a port of the evacuated enclosure, and a plenum attached to the evacuated enclosure and configured to direct coolant flow across a short axis of the evacuated enclosure window. In some embodiments, the flow of coolant across the short axis of the evacuated enclosure window may increase the rate of heat transfer from the evacuated enclosure window, resulting in increased reliability and maximum power capabilities compared to some other x-ray tubes.

Reference will now be made to the figures wherein like structures will be provided with like reference designations. It is understood that the figures are diagrammatic and schematic representations of some embodiments of the invention, and are not limiting of the present invention, nor are they necessarily drawn to scale.

I. Example Operating Environment

Figure 1A:
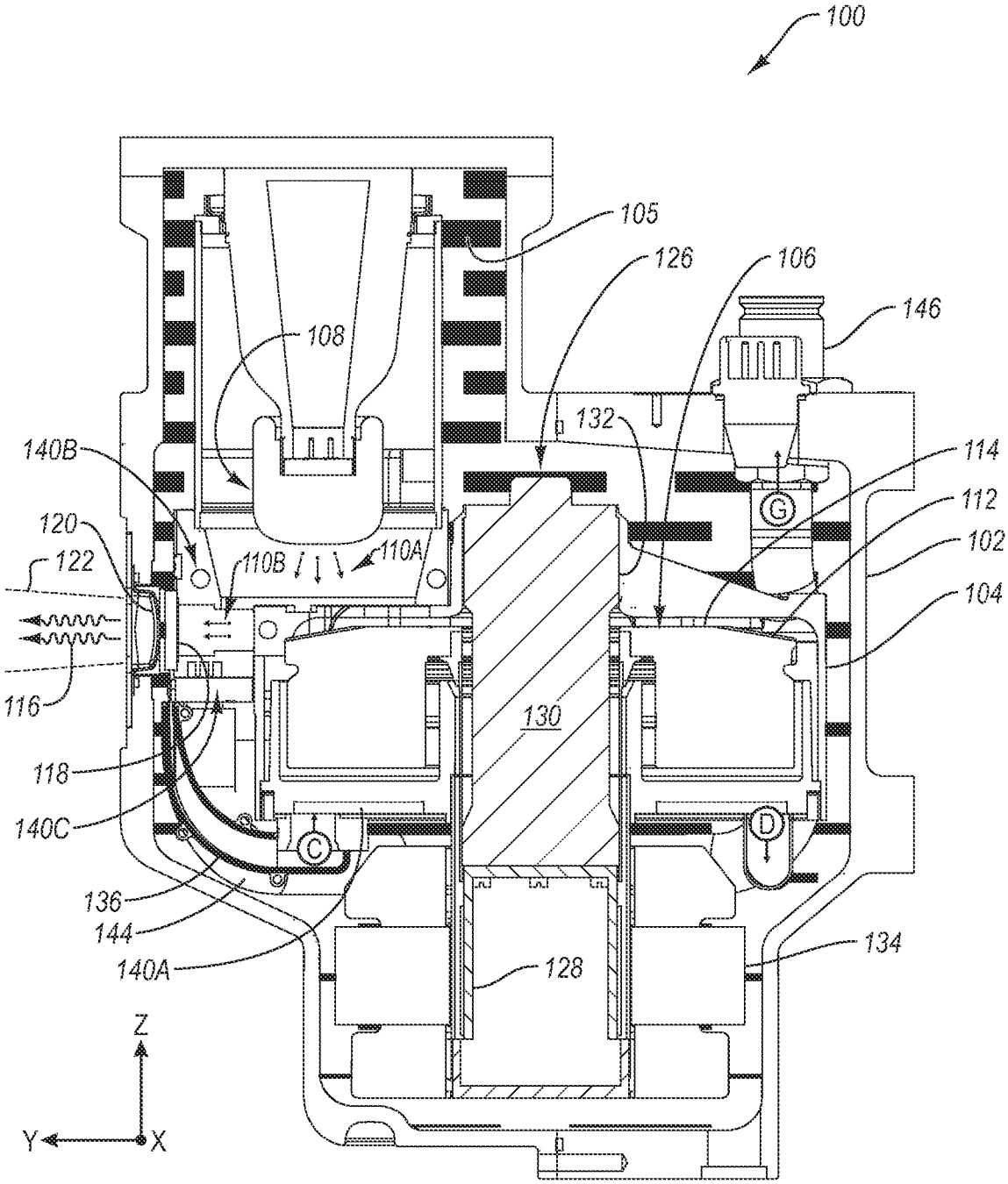
FIG. 1A is a simplified cross-sectional depiction of an x-ray tube employing a plenum according to some embodiments of the invention.

Reference is first made to FIG. 1A, which illustrates a simplified structure of a rotating anode-type x-ray tube, designated generally at 100. The x-ray tube 100 of FIG. 1A is shown in cross-section. X-ray tube 100 includes an outer housing 102, within which is disposed an evacuated enclosure 104. A coolant 105 is also disposed within the outer housing 102 and circulates around the evacuated enclosure 104 to assist in x-ray tube cooling and to provide electrical isolation between the evacuated enclosure 104 and the outer housing 102. In some embodiments, the coolant 105 comprises a cooling fluid such as dielectric oil, which exhibits desirable thermal and electrical insulating properties for some applications, although cooling fluids other than dielectric oil can alternately or additionally be implemented in the x-ray tube 100. In some embodiments, the coolant 105 is purposefully directed around the evacuated enclosure 104 to particular high temperature areas, as explained below in greater detail.

Disposed within the evacuated enclosure 104 are an anode 106 and a cathode 108. The anode 106 is spaced apart from and oppositely disposed to the cathode 108, and may be at least partially composed of a thermally conductive material such as copper or a molybdenum alloy for example. The anode 106 and cathode 108 are connected in an electrical circuit that allows for the application of a high voltage potential between the anode 106 and the cathode 108. The cathode 108 includes a filament (not shown) that is connected to an appropriate power source and, during operation, an electrical current is passed through the filament to cause electrons, designated at 110A, to be emitted from the cathode 108 by thermionic emission. The application of a high voltage differential between the anode 106 and the cathode 108 then causes the electrons 110A to accelerate from the cathode filament toward a focal track 112 that is positioned on a target 114 of the anode 106. The focal track 112 may be composed for example of tungsten or other material(s) having a high atomic ("high Z") number. As the electrons 110A accelerate, they gain a substantial amount of kinetic energy, and upon striking the target material on the focal track 112, some of this kinetic energy is converted into electromagnetic waves of very high frequency, i.e., x-rays 116, shown in FIG. 1A.

The focal track 112 is oriented so that emitted x-rays are directed toward an evacuated enclosure window 118. The evacuated enclosure window 118 is positioned within a port defined in a wall of the evacuated enclosure 104 at a point aligned with the focal track 112. Additionally, the evacuated enclosure window 118 is comprised of an x-ray transmissive material, such as beryllium or other suitable material(s).

An outer housing window 120 is disposed so as to be at least partially aligned with the evacuated enclosure window 118. The outer housing window 120 is similarly comprised of an x-ray transmissive material and is disposed in a port defined in a wall of the outer housing 102. The x-rays 116 that emanate from the evacuated enclosure 104 and pass through the outer housing window 120 may do so substantially as a conically diverging beam, the path of which is generally indicated at 122 in FIG. 1A.

The anode 106 is rotatably supported by an anode support assembly 126. The anode support assembly 126 generally comprises a rotor sleeve 128 and a bearing assembly 130 having a housing 132. The housing 132 is fixedly attached to a portion of the evacuated enclosure 104 such that the anode 106 is rotatably supported by the housing 132 via the bearing assembly 130, thereby enabling the anode 106 to rotate with respect to the housing 132. A stator 134 is disposed about the rotor sleeve 128 and utilizes rotational electromagnetic fields to cause the rotor sleeve 128 to rotate. The rotor sleeve 128 is attached to the anode 106, thereby enabling the rotation of the anode 106 during x-ray tube 100 operation.

As explained above, the focal track 112 is oriented so that emitted x-rays 116 are directed toward the evacuated enclosure window 118. The orientation of the focal track 112 also results in some of the electrons 110A being deflected off of the focal track 112 towards an interior surface of the evacuated enclosure window 118. These deflected electrons are referred to as "backscatter electrons" herein, and are designated in FIG. 1A at 110B. The backscatter electrons 110B have a substantial amount of kinetic energy. When the backscatter electrons 110B strike the interior surface of the evacuated enclosure window 118, a significant amount of the kinetic energy of the backscatter electrons 110B is transferred to the evacuated enclosure window as thermal energy.

Accordingly, the x-ray tube 100 additionally includes a plenum 136 that is configured to direct coolant 105 across the evacuated enclosure window 118. In particular, the plenum 136 is positioned proximate the evacuated enclosure window 118 and can be connected to a cooling system employed in the x-ray tube 100 so as to discharge, draw, or otherwise direct coolant 105 across the evacuated enclosure window 118.

Figure 1B:
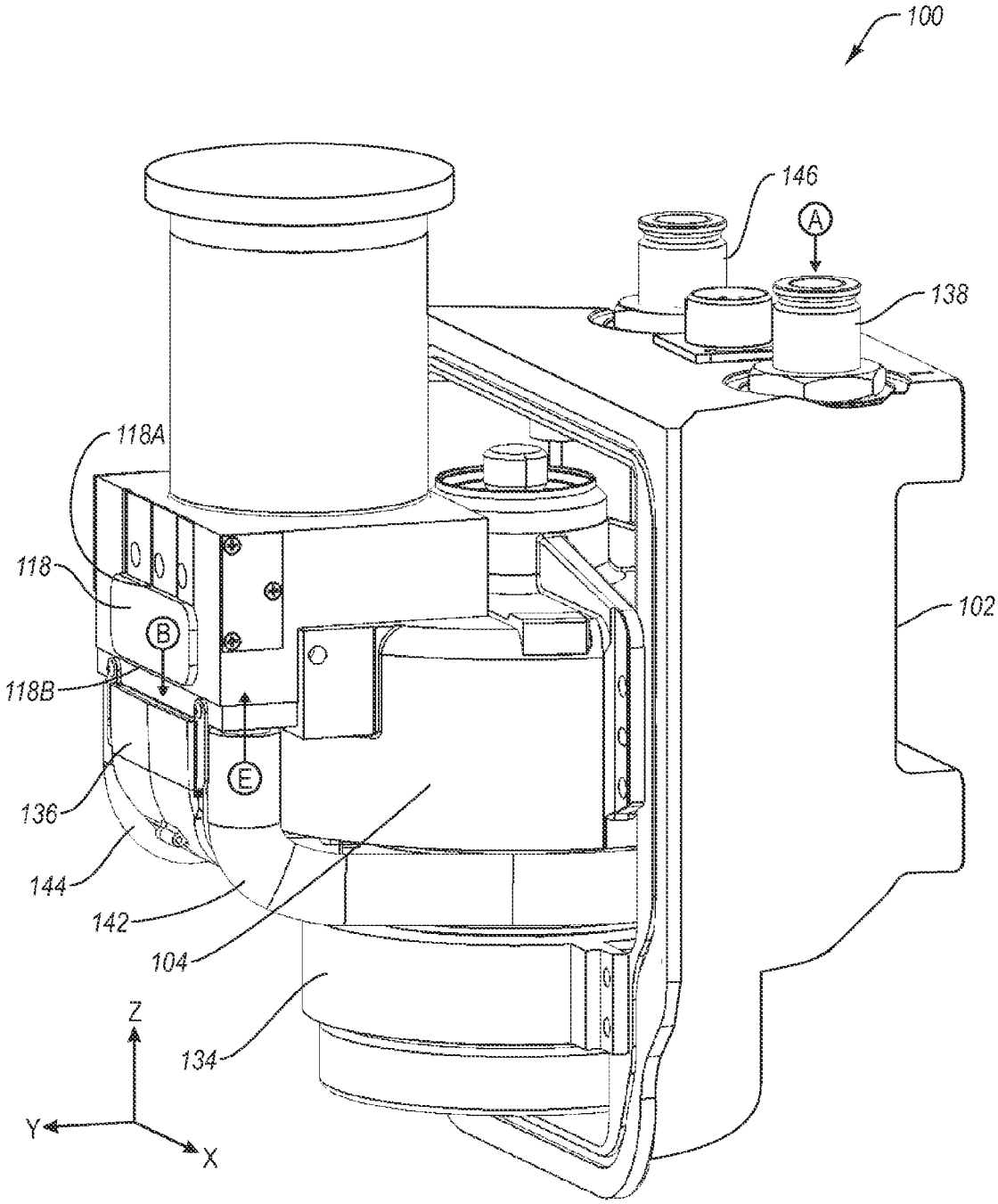
FIG. 1B is a perspective view of the x-ray tube of FIG. 1A.
Figure 1C:
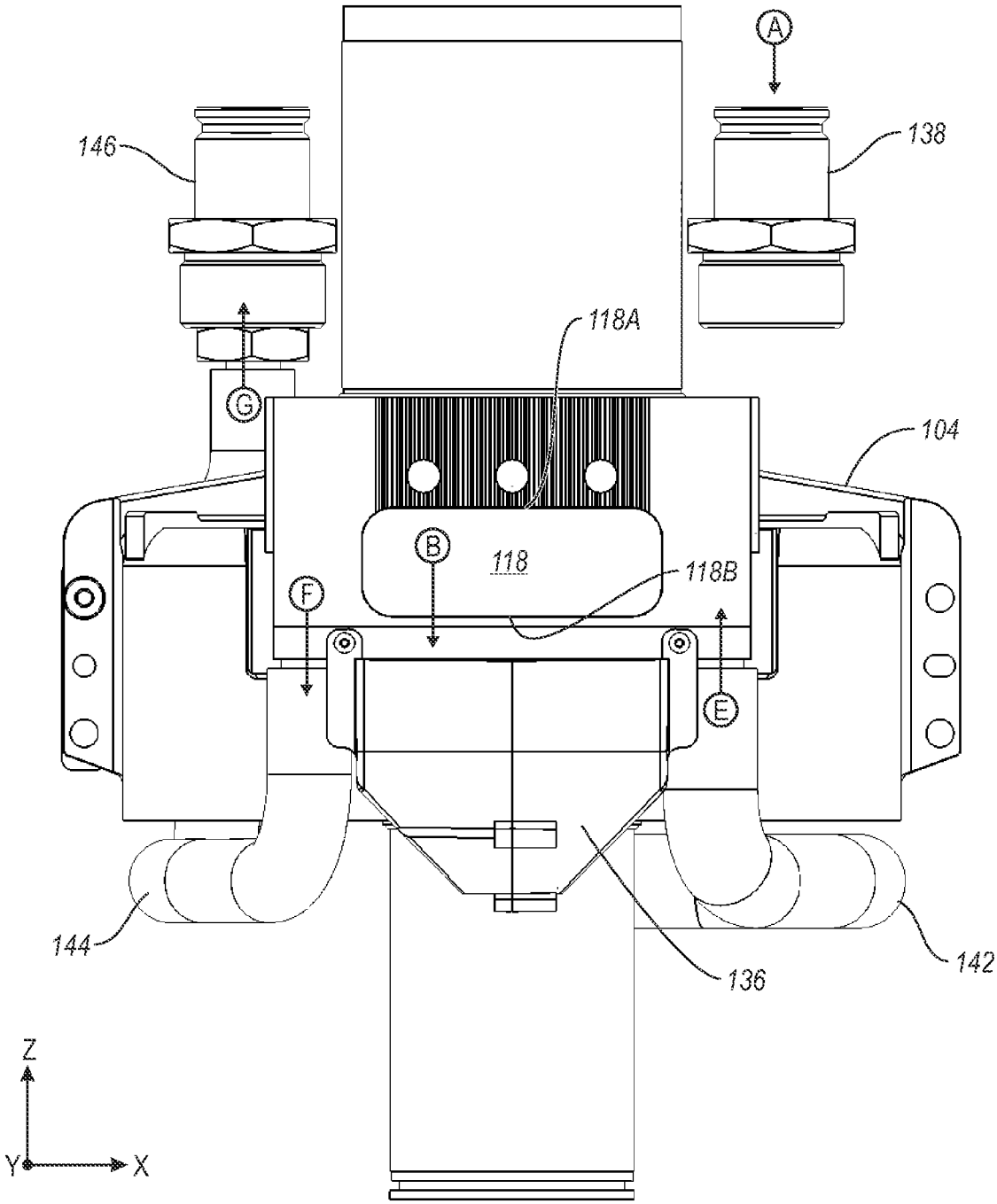
FIG. 1C is a front view of some of the components of the x-ray tube of FIG. 1A.

With additional reference to FIGS. 1B and 1C, aspects of the example plenum 136 and cooling system are disclosed. FIG. 1B discloses a perspective view of the x-ray tube 100 with a portion of the outer housing 102 removed, while FIG. 1C discloses a front view of some of the components of the x-ray tube 100, including the evacuated enclosure 104 and the plenum 136.

As disclosed in FIGS. 1A-1C, the plenum 136 is attached to the evacuated enclosure 104 and is positioned proximate the evacuated enclosure window 118 so as to direct coolant 105 across the evacuated enclosure window 118. The flow of coolant 105 convectively cools the evacuated enclosure window 118 and/or other portions of the x-ray tube 100. In other embodiments, the plenum 136 can be attached to the outer housing 102 and/or to other components of the x-ray tube 100.

In the example of FIGS. 1A-1C, the plenum 136 comprises an intake plenum configured to direct coolant 105 across the evacuated enclosure window 118 from a cathode side 118A (FIGS. 1B, 1C) to an anode side 118B (FIGS. 1B, 1C) of the evacuated enclosure window 118 and then into the plenum 136. In other embodiments, the plenum 136 is positioned so as to direct coolant 105 across the evacuated enclosure window 118 from the anode side 118B to the cathode side 118A. Alternately or additionally, the plenum 136 comprises a discharge plenum positioned and configured to direct coolant 105 out of the plenum 136 and across the evacuated enclosure 118 from the cathode side 118A to the anode side 118B, or vice versa.

According to some example embodiments, the plenum 136 is connected to a cooling system, including a coolant supply 138 (FIGS. 1B, 1C), a plurality of evacuated enclosure cavities 140A, 140B, 140C (FIG. 1A), a first hose 142 or other fluid conduit (FIGS. 1B, 1C), a second hose 144 or other fluid conduit (FIGS. 1A-1C), and a coolant return 146 (FIGS. 1A-1C). Optionally, the coolant supply 138 and coolant return 146 connections are connected to a pump and/or an external heat exchanger.

An example mode of operation of the cooling system and plenum 136 will now be described with reference to letters A-G which identify various general reference points as coolant 105 flows through the cooling system. At A (FIGS. 1B, 1C), coolant 105 flows into the outer housing 102 via coolant supply 138 to circulate around the evacuated enclosure 104. At B (FIGS. 1B, 1C), the plenum 136 directs the coolant 105 across the evacuated enclosure window 118 in a direction substantially parallel to a short axis (see FIG. 2A) of the evacuated enclosure window 118 and into the plenum 136. The coolant flows through the plenum 136 to C (FIG. 1A), whereupon the coolant 105 flows into evacuated enclosure cavity 140A (FIG. 1A). The coolant 150 flows through the evacuated enclosure cavity 140A to D (FIG. 1A), whereupon the coolant 105 enters the first hose 142 (FIGS. 1B, 1C). The coolant 105 flows through the first hose 142 to E (FIGS. 1B, 1C) and then into evacuated enclosure cavities 140B and 140C (FIG. 1A). The coolant 105 flows through the evacuated enclosure cavities 140B, 140C to F (FIG. 1C) and then into the second hose 144. The coolant 105 flows through the second hose 144 to G (FIGS. 1A, 1C) and exits the x-ray tube 100 via coolant return 146. In some examples, the coolant 105 exiting via coolant return 146 is circulated by a pump to an external heat exchanger or is otherwise cooled before being circulated back into the x-ray tube 100 via coolant supply 138.

The example mode of operation described with respect to reference letters A-G is only one example of an operation mode for circulating coolant through the x-ray tube 100. In other embodiments, the coolant 105 is circulated in the opposite direction from that described, e.g. the coolant 105 is circulated from G to A, rather than from A to G. Alternately or additionally, the coolant can be directed across the evacuated enclosure window without also being circulated through one or more of the coolant supply 138, coolant return 146, evacuated enclosure cavities 140A-140C, and/or hoses 142, 144.

FIGS. 1A-1C disclose one example environment in which a plenum 136 according to embodiments of the invention might be utilized. However, it will be appreciated that there are many other x-ray tube configurations and environments for which embodiments of the plenum 136 would find use and application. Accordingly, the scope of the invention is not limited to the examples disclosed in the Figures.

II. Thermal Energy Distribution

According to some embodiments, the plenum 136 is configured to optimize the flow of coolant 105 across the exterior surface of the evacuated enclosure 118 window. The flow of coolant 105 can be optimized based on the distribution of backscatter electrons 110B as they strike the interior surface of the evacuated enclosure window 118, which distribution directly influences thermal energy flux from the interior surface to the exterior surface of the evacuated enclosure window 118 and thermal energy concentration at the exterior surface of the evacuated enclosure window 118. As such, before explaining how the flow of coolant 105 is optimized, the following section describes one possible distribution of backscatter electrons 110B as they strike the evacuated enclosure window 118.

Figure 2A:
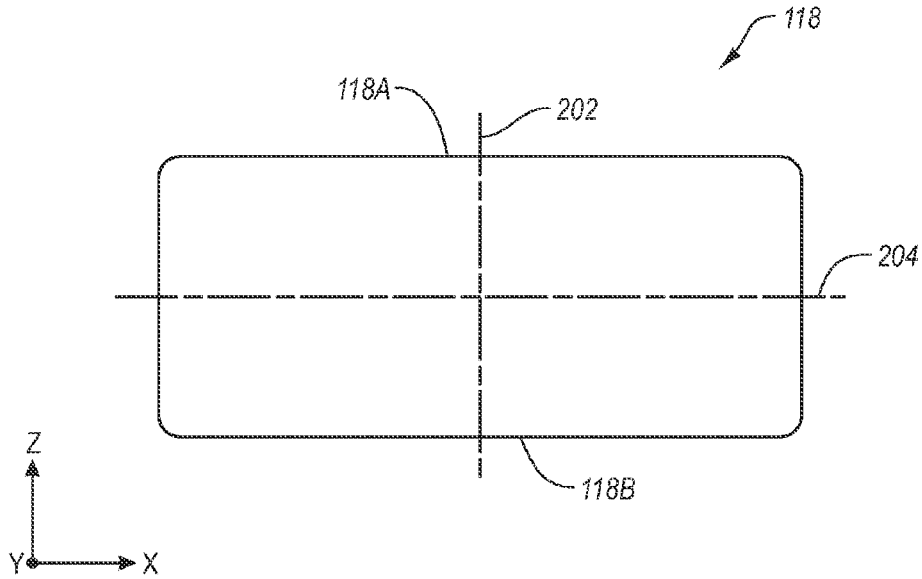
FIG. 2A is a front view of an evacuated enclosure window such as may be employed in the x-ray tube of FIG. 1A.

Reference is first made to FIG. 2A, which discloses a front view of the evacuated enclosure window 118. In the illustrated example, the evacuated enclosure window 118 is substantially rectangular in shape and includes a short axis 202 and a long axis 204. In some embodiments, the evacuated enclosure window 118 is disposed relative to the anode 106 such that the short axis 202 is substantially parallel to an axis of rotation $A_1$ (see FIG. 2C) of the anode 106, and the long axis 204 is substantially perpendicular to the short axis 202. Further, as best seen in FIGS. 2B and 2C, the evacuated enclosure window 118 can be substantially planar.

In other embodiments, the evacuated enclosure window 118 may have other shapes, such as, but not limited to, substantially elliptical, substantially square, or the like. Alternately or additionally, the evacuated enclosure window 118 can be curved or bent in two or more planes. In these and other embodiments, the "short axis" of the evacuated enclosure window 118 refers to an axis of the evacuated enclosure window 118 that is substantially parallel to an axis of rotation of a corresponding anode and that is shorter than a corresponding long axis of the evacuated enclosure window 118.

As shown in FIG. 2A, the evacuated enclosure window 118 includes a cathode side 118A and an anode side 118B. In general, the cathode side 118A refers to the side of the evacuated enclosure window 118 that is closest to the cathode 108 (see FIG. 1A) in the arbitrarily defined z-direction. Similarly, the anode side 118B refers to the side of the evacuated enclosure window 118 that is closest in the z-direction to the anode 106 (see FIG. 1A).

Figure 2B:
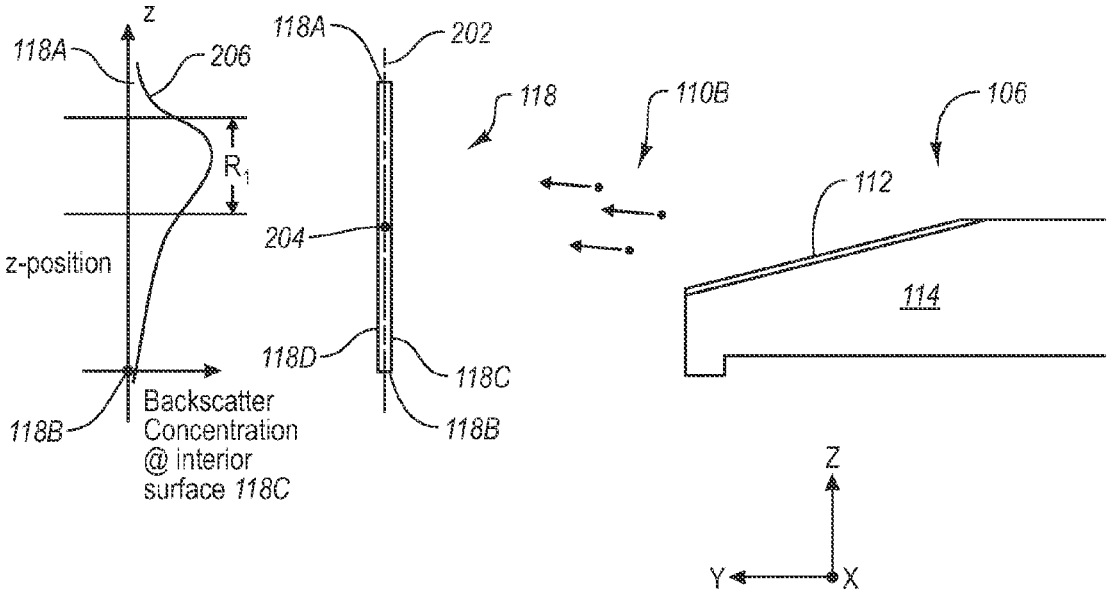
FIG. 2B is a cross-sectional side view of the evacuated enclosure window of FIG. 2A, further illustrating an example distribution in a z-direction of backscatter electrons at the evacuated enclosure window.
Figure 2C:
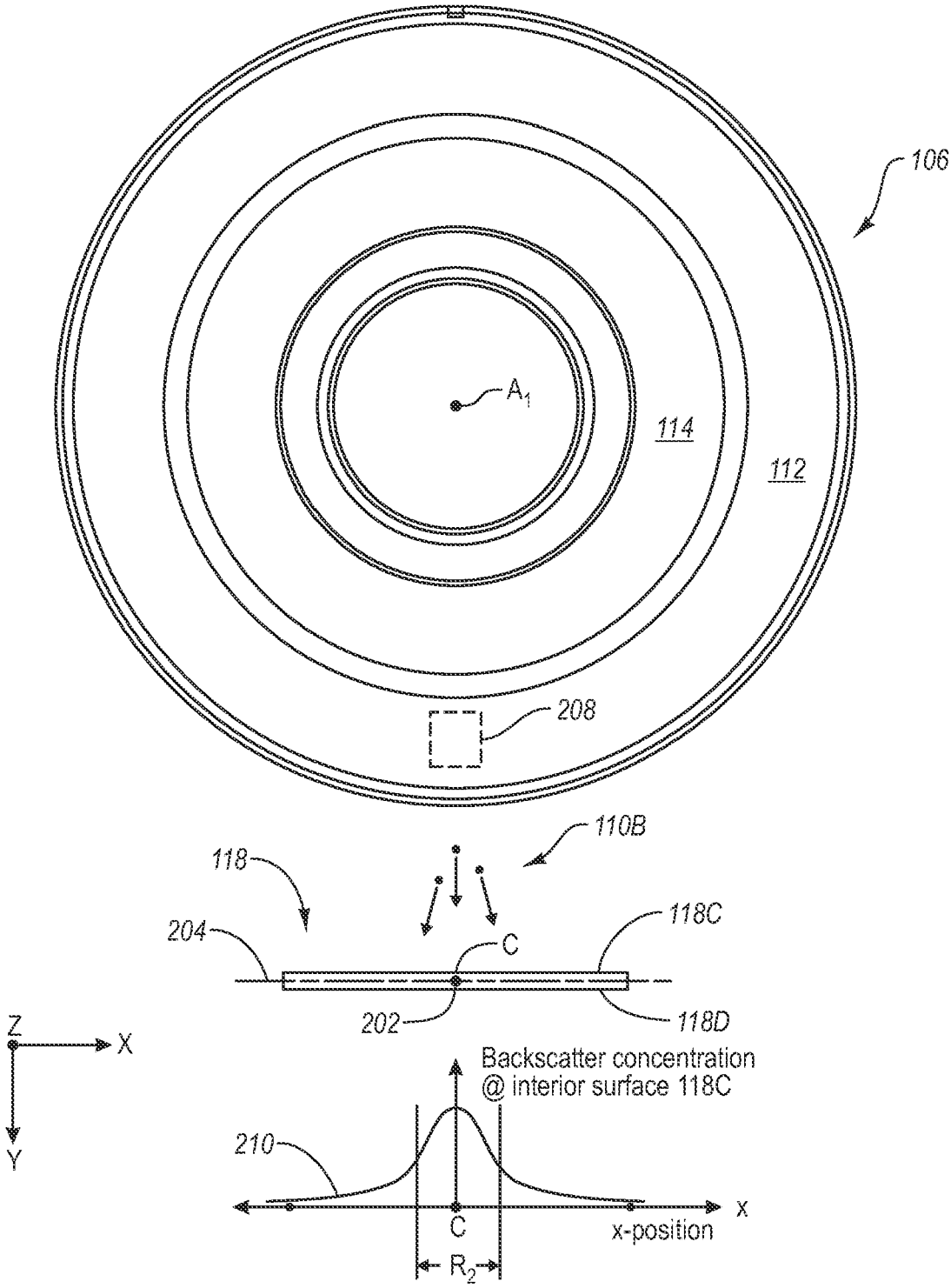
FIG. 2C is a top view of the evacuated enclosure window and anode of FIG. 2B, further illustrating an example distribution in an x-direction of backscatter electrons at the evacuated enclosure window.

With additional reference to FIG. 2B, a simplified cross-sectional side view of the evacuated enclosure window 118 and anode 106 is disclosed. As shown, the focal track 112 is angled relative to the arbitrarily defined x-y plane. In some embodiments, and due to, among other things, the angle of the focal track 112, backscatter electrons 110B may generally strike an interior surface 118C of the evacuated enclosure window 118 with a non-uniform z-direction distribution concentrated nearer to the cathode side 118A than to the anode side 118B.

For instance, curve 206 represents one example of a non-uniform z-direction distribution of backscatter electrons 110B that are concentrated in a region $R_1$ that is nearer to the cathode side 118A than to the anode side 118B. The distribution curve 206 of backscatter electrons 110B in the z-direction is only provided as an example—other x-ray tube configurations within the scope of the claimed invention may have non-uniform z-direction distributions of backscatter electrons that are represented by similar or different distribution curves.

The backscatter electrons 110B transfer a significant amount of their kinetic energy to the evacuated enclosure window 118 as thermal energy at the points where the backscatter electrons 110B strike the evacuated enclosure window 118. Consequently, the distribution in the z-direction of thermal energy at the interior surface 118C generally correlates to the distribution in the z-direction of backscatter electrons 110B represented by the distribution curve 206.

The thermal energy at the interior surface 118C is conductively transferred through the evacuated enclosure window 118. Because a thickness of the evacuated enclosure window 118 (e.g., measured in the y-direction) is significantly less than the height (e.g. measured in the z-direction) and length (e.g., measured in the x-direction), the distribution of thermal energy in the z-direction at an exterior surface 118D of the evacuated enclosure window 118 also generally correlates to the distribution in the z-direction of backscatter electrons 110B represented by the distribution curve 206. In other words, the exterior surface 118D is generally hotter near the cathode side 118A than near the anode side 118B.

With additional reference to FIG. 2C, a simplified top view of the evacuated enclosure window 118 and anode 106 is disclosed. FIG. 2C discloses, among other things, the axis of rotation Al of the anode 106 and a focal spot 208 on the focal track 112 where electrons emitted by the cathode 108 (see FIG. 1A) are focused. As shown, the short axis 202 is substantially parallel to the axis of rotation $A_1$. Additionally, the evacuated enclosure window 118 is positioned relative to the anode 106 such that a center C in the x-direction of the evacuated enclosure window 118, e.g., the portion of the evacuated enclosure window 118 through which the short axis 202 passes, is closer to the focal spot 208 than other portions of the evacuated enclosure window 118.

In some embodiments, and due to, among other things, the center C being closer to the focal spot 208 than the other portions of the evacuated enclosure window 118, backscatter electrons 110B generally strike the interior surface 118C with a non-uniform x-direction distribution concentrated around the center C. For instance, curve 210 represents one example of a non-uniform x-direction distribution of backscatter electrons 110B that are concentrated in a region $R_2$ centered about the center C. The distribution curve 210 of backscatter electrons 110B in the x-direction is only provided as an example-other x-ray tube configurations within the scope of the claimed invention may have non-uniform x-direction distributions of backscatter electrons that are represented by similar or different distribution curves.

Similar to the distribution of thermal energy in the z-direction at the interior surface 118C and exterior surface 118D, the distribution of thermal energy in the x-direction at the interior surface 118C and exterior surface 118D generally correlates to the distribution of backscatter electrons 110B in the x-direction represented by the distribution curve 210. In other words, the interior and exterior surfaces 118C, 118D are generally hotter near the center C of the evacuated enclosure window 118.

III. Optimizing Coolant Flow

Figure 3A:
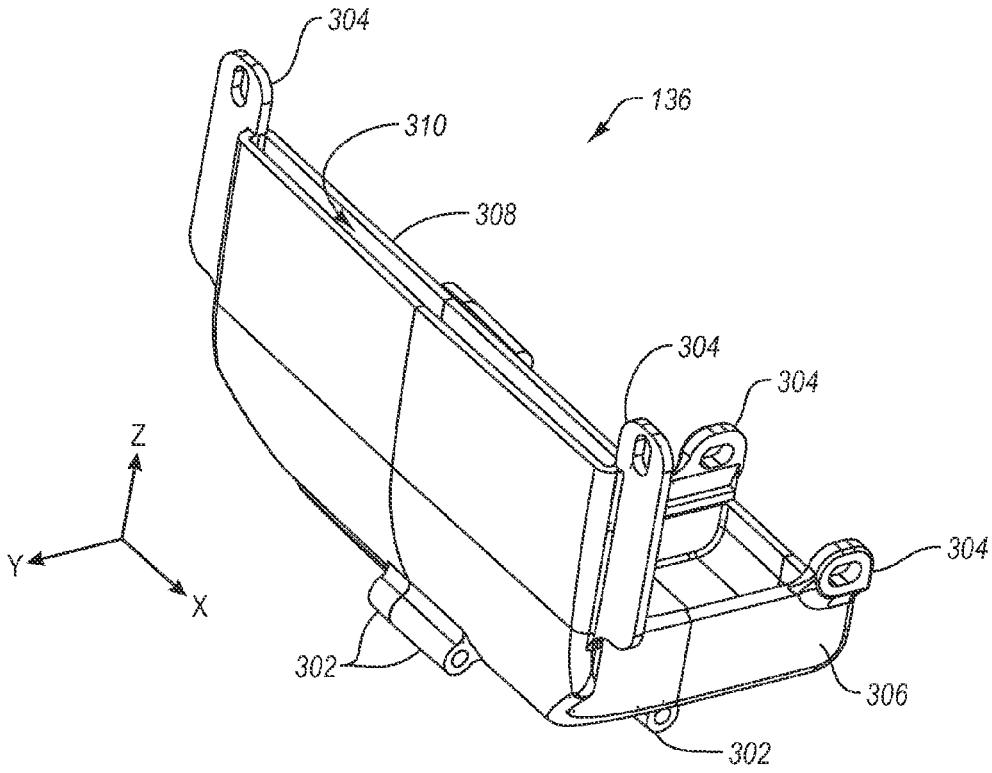
FIGS. 3A and 3B include a perspective view and a top view of the plenum of FIG. 1A.
Figure 3B:
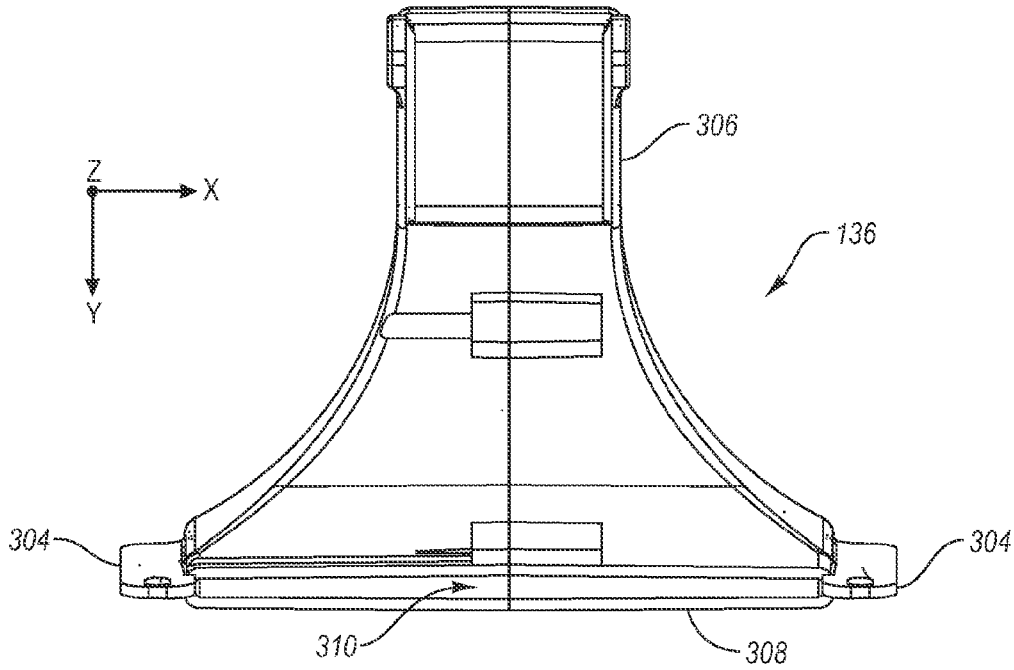

With additional reference to FIGS. 3A and 3B, a perspective view and a top view of the example plenum 136 are disclosed. As shown in FIG. 3A, a plurality of structures 302 are employed to secure two or more separate pieces together to form the plenum 136. For instance, a first set of the structures 302 are formed on a first portion of the plenum 136 and a second set of the structures 302 are formed on a second portion of the plenum 136, each of the first and second portions of the plenum 136 being a separate piece. The structures on the first portion of the plenum 136 can generally be aligned with the structures on the second portion of the plenum 136 such that screws, bolts, adhesives or other securing means can be employed to secure the two portions of the plenum 136 together via the structures 302. In other embodiments, the plenum 136 is an integrally formed component.

In some embodiments, the plenum 136 may include a plurality of tabs 304 with through holes formed therein. The plenum 136 can be secured to the evacuated enclosure 104 or other component of the x-ray tube 100 by inserting screws or other fasteners through the through holes of tabs 304 and into the evacuated enclosure 104 or other structure. Other securing arrangements implementing screws, bolts, clips, posts, adhesives or other means for securing can alternately or additionally be employed to secure the plenum 136 to the evacuated enclosure 104 or to other structure within the x-ray tube 100.

As shown in FIGS. 3A and 3B, the plenum 136 includes a first end 306 and a second end 308. The first end 306 is configured to be attached to the cooling system of FIGS. 1A-1C. In particular, in the present example, the first end 306 is configured to be attached to the evacuated enclosure cavity 140A, as best seen in FIG. 1A, to allow coolant 105 to flow from the plenum 136 into the evacuated enclosure cavity 140A.

The plenum 136 includes one or more openings 310 formed in the second end 308 through which coolant 105 can flow. Optionally, embodiments of the plenum 136 can be manufactured with one or more punchout portions or knockouts formed in the second end 308. In some embodiments, the punchout portions or knockouts can be selectively removed to customize the plenum 136 for a particular device or application.

The plenum 136 is generally positioned relative to the evacuated enclosure window 118 such that coolant flows into or out of the opening 310 in a direction substantially parallel to the short axis 202 of evacuated enclosure window 118. For instance, in the illustrated embodiment, the plenum 136 is arranged such that the second end 308 is substantially normal to the short axis 202. More particularly, the plenum 136 is arranged such that the second end 308 is substantially normal to any plane that is substantially parallel to the short axis 202. In other embodiments, the plenum 136 is not arranged such that the second end 308 is substantially normal to the short axis 202.

The second end 308 is configured to be disposed proximate the evacuated enclosure window 118 so as to direct coolant 105 across the exterior surface 118D of evacuated enclosure window 118 in a direction substantially parallel to the short axis 202 (FIG. 2A) of evacuated enclosure window 118. As such, the plenum 136 serves as one example of a structural implementation of a means for directing coolant flow. In this embodiment, the means directs coolant flow across the exterior surface 118D of evacuated enclosure window 118 in a direction substantially parallel to the short axis 202.

In this and other examples, directing coolant to flow across the exterior surface 118D in a direction substantially parallel to the short axis 202 minimizes the distance the coolant 105 flows across the evacuated enclosure window 118 so as to maximize the cooling effect provided by the coolant 105. In contrast, directing flow across the long axis of an evacuated enclosure window preferentially cools one end of the evacuated enclosure window more than the other end of the evacuated enclosure window, resulting in undesirable stresses in the window.

Alternately or additionally, the plenum 136 can be configured in some embodiments to optimize the flow of coolant 105 according to the non-uniform distribution of backscatter electrons 110B at the interior surface 118C of the evacuated enclosure window 118. In some embodiments, optimizing the flow of coolant 105 according to the non-uniform distribution includes directing the coolant 105 initially across areas of the exterior surface 118D having a higher concentration of thermal energy than other areas of the exterior surface 118D and then directing the coolant 105 across the other areas of the exterior surface 118D. For example, as best seen in FIG. 1A, the plenum 136 can be positioned within the x-ray tube 100 so as to direct coolant flow from the cathode side 118A, e.g. the hot side, to the anode side 118B, e.g. the relatively cooler side, of the exterior surface 118D of evacuated enclosure window 118.

Directing coolant flow from the cathode side 118A to the anode side 118B maximizes the temperature gradient between the coolant 105 and the cathode side 118A in order to maximize heat transfer away from the relatively hotter cathode side 118A. As a result, the temperature of the coolant 105 increases as the coolant 105 flows towards the anode side 118B. However, because the anode side 118B is cooler than the cathode side 118A due to the non-uniform distribution of backscatter electrons 110B in the z-direction, the coolant 105 is able to transfer sufficient heat away from the anode side 118B to cool the anode side 118B to a manageable temperature despite the temperature of the coolant 105 at the anode side 118B being greater than at the cathode side 118A.

Accordingly, in the example of FIGS. 1A-1C where the plenum 136 comprises an intake plenum, meaning coolant 105 flows into the plenum 136 via opening 310 at the second end 308 (FIGS. 3A-3B) of the plenum 136, the second end 308 is positioned nearer to the anode side 118B than to the cathode side 118A. Thus, coolant 105 is directed across the exterior surface 118D of the evacuated enclosure window 118 from the cathode side 118A to the anode side 118B before flowing into the plenum 136 via opening 310 at the second end 308.

Alternately or additionally, where the plenum 136 comprises a discharge plenum, meaning coolant 105 flows out of the plenum 136 via opening 310 at the second end 308 (FIGS. 3A-3B), the plenum 136 can optionally be positioned differently than shown in FIGS. 1A-1C. In particular, the plenum 136 can be positioned within the x-ray tube 100 with the second end 308 nearer to the cathode side 118A than to the anode side 118B. In this example, coolant 105 flows out of the second end 308 via opening 310 and across the exterior surface 118D of the evacuated enclosure window 118 from the cathode side 118A to the anode side 118B.

Alternately or additionally, if the anode side 118B were hotter than the cathode side 118A of the evacuated enclosure window 118 due to a non-uniform z-direction distribution of backscatter electrons 110B that was substantially the opposite of the z-direction distribution disclosed with respect to FIGS. 2A-2C, the plenum 136 could be configured as a discharge plenum and left in the same position shown in FIGS. 1A-1C so as to direct coolant 105 out of the opening 310 and across the exterior surface 118D of the evacuated enclosure window 118 from the anode side 118B to the cathode side 118A.

Alternately or additionally, if the anode side 118B were hotter than the cathode side 118A of the evacuated enclosure window 118 due to a non-uniform z-direction distribution of backscatter electrons 110B that was substantially the opposite of the z-direction distribution disclosed with respect to FIGS. 2A-2C, the plenum 136 could be positioned differently than shown in FIGS. 1A-1C and operated as an intake plenum. In particular, the plenum 136 could be positioned within the x-ray tube 100 with the second end 308 (FIGS. 3A-3B) nearer to the cathode side 118A than to the anode side 118B. In this example, the plenum 136 would direct coolant 105 across the exterior surface 118D of the evacuated enclosure window 118 from the anode side 118B to the cathode side 118A and then into the second end 308 via opening 310.

Thus, directing the coolant 105 initially across hotter areas of the exterior surface 118D before directing the coolant across cooler areas of the exterior surface 118D is one way to optimize the flow of coolant 105 according to the non-uniform distribution of backscatter electrons 110B. As another example, optimizing the flow of coolant 105 according to the non-uniform distribution of backscatter electrons 110B can include varying, in the x-direction, the coolant flow, e.g., the velocity and/or flow rate, of the coolant 105 directed across the exterior surface 118D.

Figure 4A:
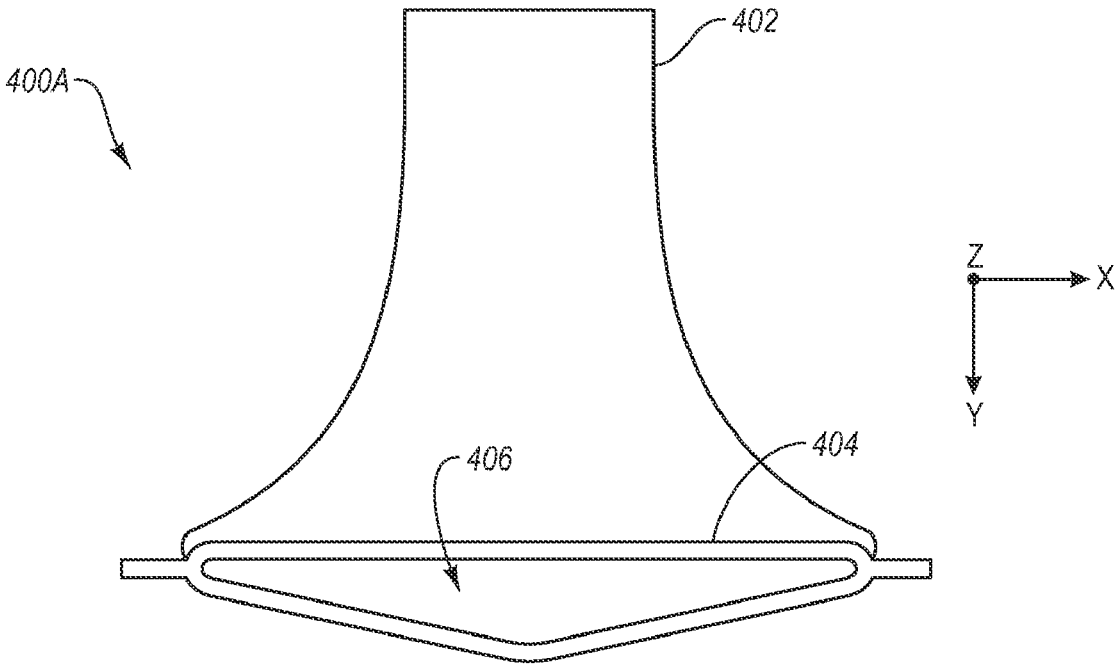
FIG. 4A illustrates an alternative embodiment of a plenum that can be employed in the x-ray tube of FIG. 1A.
Figure 4B:
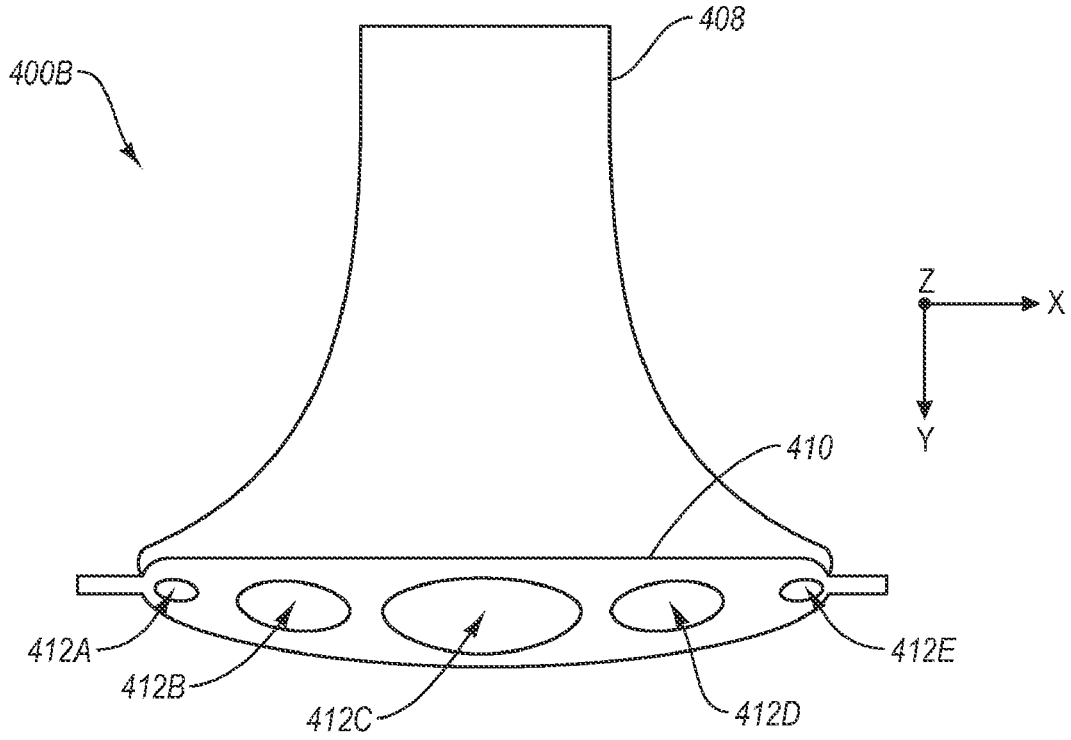
FIG. 4B illustrates another alternative embodiment of a plenum that can be employed in the x-ray tube of FIG. 1A.
Figure 5:
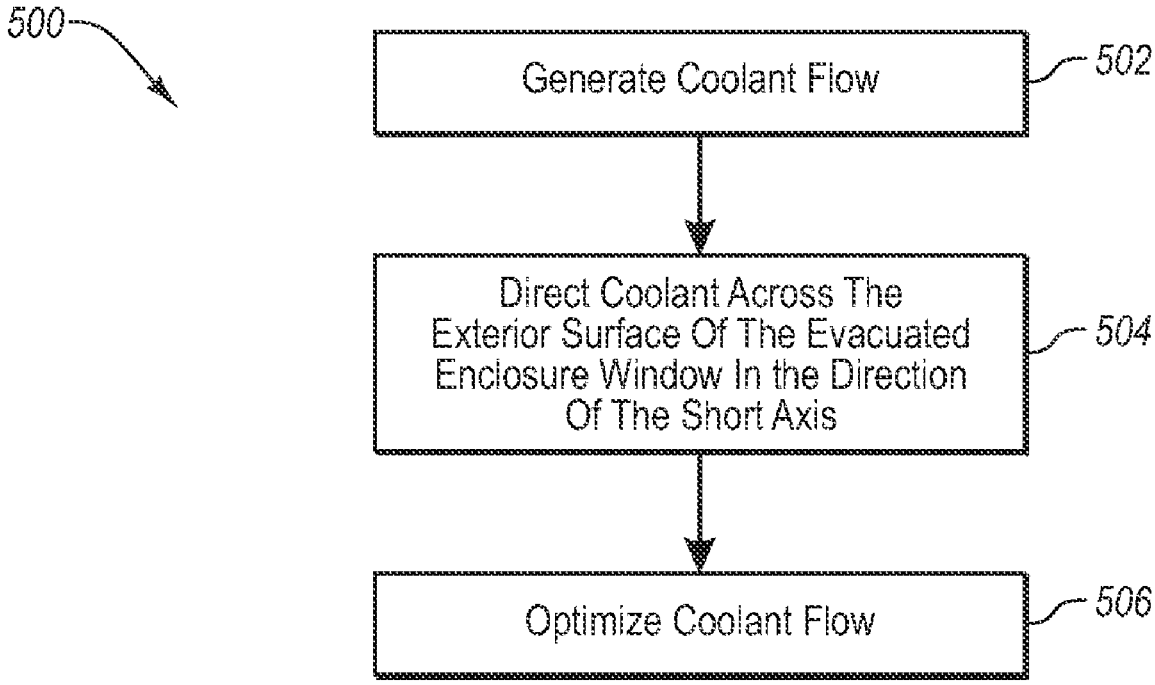
FIG. 5 illustrates a flow chart of an example method for cooling an x-ray tube.

For instance, FIGS. 4A and 4B disclose plenums 400A, 400B configured to vary, in the x-direction, the flow rate of the coolant 105 across the exterior surface 118D. FIGS. 4A and 4B illustrate top views of the plenums 400A, 400B. The plenums 400A, 400B can be employed in x-ray tubes, such as the x-ray tube 100 of FIGS. 1A-1C, in place of the plenum 136, for example.

Generally, the rate of convective heat transfer away from the evacuated enclosure window 118 by the coolant 105 is proportional to the flow rate of the coolant 105. By designing the plenums 400A, 400B to vary, in the x-direction, the flow rate of coolant 105, the heat transfer rate at the exterior surface 118D of evacuated enclosure window 118 can be made to be different at different locations in the x-direction of the exterior surface 118D. As such, plenums according to embodiments of the invention can be designed to accommodate various needs.

As shown in FIG. 4A, the plenum 400A includes a first end 402 configured to be attached to a cooling system. For instance, the first end 402 is configured to be attached to the evacuated enclosure cavity 140A of FIG. 1A such that coolant 105 can flow between the plenum 400A and the evacuated enclosure cavity 140A.

The plenum 400A also includes a second end 404 and an opening 406 formed in the second end 404. In the illustrated example, the opening 406 has a tapered shape that is wider at the middle of the opening 406 than at the ends of the opening 406. As such, a higher volume of coolant 105 is directed into or out of the middle of the opening 406 than is directed into or out of the ends of the opening 406.

Similarly, and as shown in FIG. 4B, the plenum 400B includes a first end 408 and a second end 410. In contrast to the plenum 400A of FIG. 4B, however, the plenum 400B includes a plurality of openings 412A-412E that are non-uniform in size. The non-uniformity of the openings 412A-412E allows a higher volume of coolant to flow through middle opening 412C than through the other openings 412A, 412B, 412D, 412E. The size, shape, number, location, and orientation of the openings 412A-412E may be varied and can be different for different embodiments.

Accordingly, in the examples of FIGS. 4A and 4B, the plenums 400A, 400B are configured to direct a higher volume of coolant 105 across the center C (FIG. 2C) of the evacuated enclosure window 118 than across its sides. Whereas a higher volume of coolant 105 generally has a greater capacity for cooling, the directing of a higher volume of coolant 105 across the center C provides greater cooling effect to the portion of the evacuated enclosure window 118 having the highest concentration of thermal energy in the x-direction. Thus, the tapered opening 406 by itself and/or the plurality of non-uniform openings 412A-412E serve as examples of a structural implementation of a means for varying coolant flow across the exterior surface 118D of evacuated enclosure window 118.

In the present examples, the opening(s) 406, 412A-412E formed in the first ends 404, 410 of plenums 400A, 400B are configured to direct a higher volume of coolant 105 across the center C of evacuated enclosure window 118 according to the x-direction distribution of backscatter electrons 110B having a higher concentration near the center C of the evacuated enclosure window 118. In other embodiments in which the x-direction distribution of backscatter electrons 110B has a higher concentration near a side or sides of the evacuated enclosure window 118, rather than near the center C, the opening(s) 406, 412A-412E can be formed in the first ends 404, 410 of plenums 400A, 400B so as to direct a higher volume of coolant 105 across the corresponding portion(s) of the evacuated enclosure window having a corresponding higher concentration of thermal energy.

IV. Method of Cooling

With combined reference to FIGS. 1A-2C and 5, one embodiment of a method 500 for cooling an x-ray tube is disclosed. The method 500 can be employed in various devices and operating environments, including in the x-ray tube 100 of FIGS. 1A-1C, for example. The method 500 begins by generating 502 coolant flow in the cooling system of x-ray tube 100. For instance, the coolant flow can be generated 502 by a pump connected to the cooling system, which pump may be included as part of the x-ray tube 100 or which may be separate from the x-ray tube 100.

After generating 502 coolant flow, the method 500 continues by directing 504 the coolant 105 across the exterior surface 118D of the evacuated enclosure window 118 in a direction substantially parallel to the short axis 202 of the evacuated enclosure window 118. Directing 504 the coolant 105 across the exterior surface 118D can include directing the coolant 105 out of the plenum 136 and across the exterior surface 118D. Alternately, directing 504 the coolant 105 across the exterior surface 118D can include directing the coolant 105 across the exterior surface 118D and into the plenum 136.

The method 500 further includes optimizing 506 coolant flow across the exterior surface 118D according to the non-uniform distribution of backscatter electrons that strike the interior surface 118C of evacuated enclosure window 118. Optimizing 506 coolant flow across the exterior surface 118D according to the non-uniform distribution can include varying the coolant flow of the coolant 105 directed across the exterior surface 118D. Varying the coolant flow of the coolant 105 directed across the exterior surface 118D can include directing a higher volume of coolant across a first area of the exterior surface 118D than across a second area of the exterior surface 118D. Alternately or additionally, varying the coolant flow of the coolant 105 directed across the exterior surface 118D can include directing a first portion of the coolant 105 flowing across a first area of the exterior surface 118D to flow at a higher velocity than a second portion of the coolant 105 flowing across a second area of the exterior surface 118D.

Alternately or additionally, in the case where the non-uniform distribution of backscatter electrons 110B results in the cathode side 118A being hotter than the anode side 118B, optimizing 506 coolant flow across the exterior surface 118D according to the non-uniform distribution can include directing the flow of coolant 105 initially across areas of the exterior surface 118D having a higher concentration of thermal energy than other areas of the exterior surface 118D. In particular, the flow of coolant 105 can be directed initially across the hotter cathode side 118A before being directed across the cooler anode side 118B. Further, the coolant 105 can be directed out of the plenum 136 and across the exterior surface 118D, or across the exterior surface 118D and into the plenum 136.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube, comprising:

an evacuated enclosure;

an anode disposed within the evacuated enclosure and configured to receive electrons emitted by an electron emitter;

an evacuated enclosure window disposed within a port of the evacuated enclosure; and means for directing coolant to flow in a non-uniform manner across an exterior surface of the evacuated enclosure window.

2. The x-ray tube of claim 1, wherein the evacuated enclosure window is configured to receive a higher concentration of backscatter electrons at a first side than at a second side and wherein the means for directing coolant flow is disposed relative to the evacuated enclosure window so as to direct coolant flow across the exterior surface from the first side to the second side.

3. The x-ray tube of claim 1, wherein the means for directing coolant to flow comprises a plenum.

4. The x-ray tube of claim 1, wherein the means for directing coolant to flow comprises a plurality of openings, the plurality of openings being non-uniform in size.

5. The x-ray tube of claim 1, wherein the means for directing coolant to flow comprises a tapered opening, the tapered opening having a middle and two sides, the middle of the tapered opening being wider than the sides of the tapered opening.

6. The x-ray tube of claim 1, further comprising a cooling system configured to circulate the coolant and including one or more cavities formed in the evacuated enclosure, a coolant supply, a coolant return, and one or more hoses.

7. A method of cooling an x-ray tube, comprising:

generating coolant flow in an x-ray tube comprising an evacuated enclosure window, the evacuated enclosure window including first and second axes, the first axis being relatively shorter than the second axis;

directing coolant across an exterior surface of the evacuated enclosure window in a direction substantially parallel to the first axis; and optimizing coolant flow across the exterior surface according to a non-uniform distribution of backscatter electrons that strike an interior surface of the evacuated enclosure window.

8. The method of claim 7, wherein optimizing coolant flow according to the non-uniform distribution includes varying coolant flow of the coolant across the exterior surface.

9. The method of claim 8, wherein varying coolant flow of the coolant across the exterior surface includes directing a higher volume of coolant across a first area of the exterior surface than across a second area of the exterior surface.

10. The method of claim 8, wherein varying coolant flow of the coolant across the exterior surface includes directing a first portion of the coolant flowing across a first area of the exterior surface to flow at a higher velocity than a second portion of the coolant flowing across a second area of the exterior surface.

11. The method of claim 7, wherein optimizing coolant flow according to the non-uniform distribution includes directing the coolant initially across a first area of the exterior surface before directing the coolant across a second area of the exterior surface, the first area having a higher concentration of thermal energy than the second area.

12. An x-ray tube, comprising:

an outer housing;

an evacuated enclosure disposed within the outer housing, the evacuated enclosure including an evacuated enclosure window having a short axis;

an electron emitter disposed within the evacuated enclosure and configured to emit electrons;

an anode disposed within the evacuated enclosure so as to receive electrons emitted by the electron emitter and defining an axis of rotation that is substantially parallel to the short axis; and a plenum disposed within the outer housing and having an end with at least one opening formed therein, the at least one opening configured to direct coolant in a non-uniform manner across the exterior surface of the evacuated enclosure window.

13. The x-ray tube of claim 12, wherein the evacuated enclosure window is configured to receive a higher concentration of backscatter electrons at a first side than at a second side, and wherein the at least one opening is configured to direct a higher volume of coolant to the first side than to the second side.

14. The x-ray tube of claim 12, wherein the plenum comprises an intake plenum configured to direct coolant across the exterior surface of the evacuated enclosure window and into the at least one opening.

15. The x-ray tube of claim 12, wherein the at least one opening comprises a plurality of openings that are non-uniform in size.

16. The x-ray tube of claim 15, wherein the plurality of openings include at least a middle opening and two end openings, a size of the middle opening being greater than a size of either of the two end openings.

17. The x-ray tube of claim 12, where the at least one opening comprises a tapered opening having a middle and two sides, the middle of the tapered opening being wider than the sides of the tapered opening.

18. An x-ray tube, comprising:

an evacuated enclosure;

an anode disposed within the evacuated enclosure and configured to receive electrons emitted by an electron emitter;

an evacuated enclosure window disposed within a port of the evacuated enclosure; and a fluid discharge configured to direct coolant across an exterior surface of the evacuated enclosure window from a side of the window that experiences a higher concentration of electron backscatter to a side of the window that experiences a lower concentration of electron backscatter.

19. A method of cooling an x-ray tube, comprising:

generating coolant flow in an x-ray tube comprising an evacuated enclosure window;

directing coolant across an exterior surface of the evacuated enclosure window; and optimizing coolant flow across the exterior surface according to a non-uniform distribution of backscatter electrons that strike an interior surface of the evacuated enclosure window.

* * * * *